United States Patent [19]

Cavanagh

[11] 4,164,203

[45] Aug. 14, 1979

[54] FUEL PUMP INJECTOR

[75] Inventor: Eric J. Cavanagh, Surbiton, England

[73] Assignee: Lucas Industries Limited, Birmingham, England

[21] Appl. No.: 760,582

[22] Filed: Jan. 19, 1977

[30] Foreign Application Priority Data

Jan. 20, 1976 [GB] United Kingdom ..... 2105/76

[51] Int. Cl.[2] ..... F02M 51/06

[52] U.S. Cl. ..... 123/32 JV

[58] Field of Search ..... 123/32 JV, 32 AB, 32 AE, 123/32 EF, 32 JN, 139 E; 239/584, 585, 88; 417/416, 557, 415, 443

[56] References Cited

U.S. PATENT DOCUMENTS

| | | | |
|---|---|---|---|
| 2,557,880 | 6/1951 | Lynn | 417/443 |
| 3,139,952 | 7/1964 | Jackson | 417/416 |
| 3,190,561 | 6/1965 | Fuller et al. | 239/584 |
| 3,468,257 | 9/1969 | Kofink | 417/415 |
| 3,623,460 | 11/1971 | Komaroff et al. | 123/32 JV |

*Primary Examiner*—Charles T. Jordan

*Attorney, Agent, or Firm*—Holman & Stern

[57] ABSTRACT

A fuel pump injector includes a plunger movable within a bore at one end of which there is a valve controlled outlet. A return spring is provided for the plunger and an electromagnetic device which includes a push member is provided to move the plunger in the direction of the outlet. A fuel inlet port is provided in the bore and this is covered by the plunger during its movement towards the outlet whereafter the pressurized fuel within the bore opens the valve to permit flow of fuel to the engine.

6 Claims, 3 Drawing Figures

FUEL PUMP INJECTOR

This invention relates to a fuel pump injector of the kind intended to be mounted on an internal combustion engine and having an outlet through which fuel flows to a combustion space of the engine.

The object of the invention is to provide such a pump injector in a simple and convenient form.

According to the invention a fuel pump injector comprises in combination, a housing, a bore defined in the housing, a plunger slidable within the bore, an outlet at one end of the bore, a valve for controlling fuel flow through said outlet, a fuel supply port opening into the bore at a position so that it is covered by the plunger during movement thereof towards said one end of the bore and an electromagnetic device for urging the plunger towards said one end of the bore whereby when said port is covered fuel is discharged through said outlet.

According to a further feature of the invention a return spring is provided for said plunger.

According to a still further feature of the invention said electromagnetic device includes an armature and a winding which when energised effects movement of said plunger in a direction towards said one end of the bore, said device including resilient means which returns said armature when the winding is de-energised.

Two examples of a pump injector in accordance with the invention will now be described with reference to the accompanying drawings in which.

Figure 1:
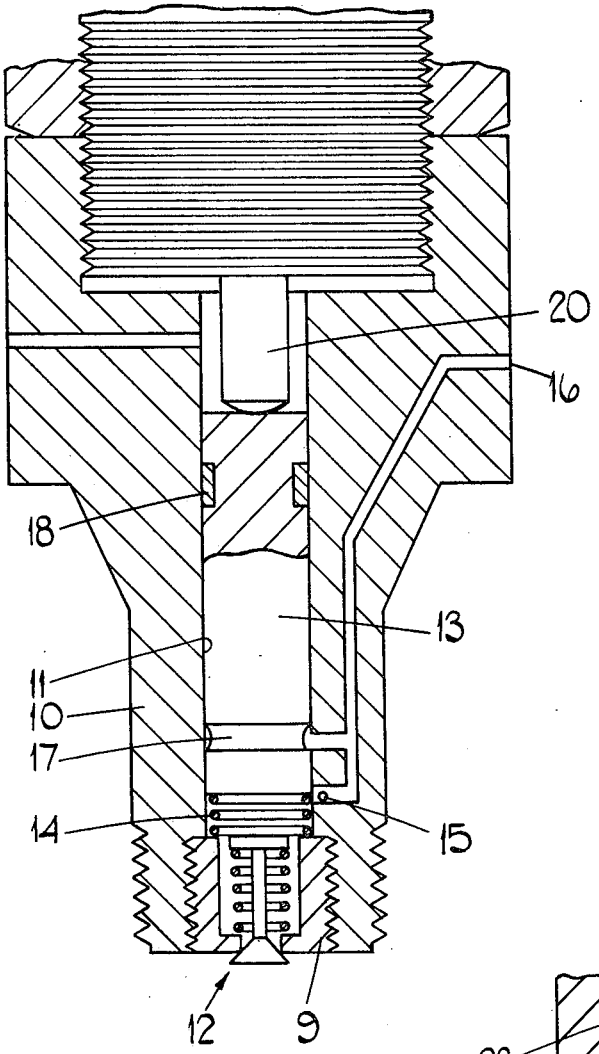
FIG. 1 is a sectional side elevation through part of one example of an inector.

With reference to FIG. 1 the fuel pump injector comprises a housing 10 in which is defined an axial bore 11. At one end the housing is provided with a peripheral screw thread whereby the housing can be secured in the cylinder head of the engine and the adjacent end of the bore is provided with a screw threaded insert 9 which defines a valve controlled outlet 12. As will be seen from FIG. 1, the outlet includes a poppet valve member which is spring loaded to a closed position and which is opened by the action of fuel under pressure within the bore 11.

Slidable within the bore is a plunger 13 and this is loaded away from the outlet 12 by means of a coiled compression spring 14.

Opening into the bore 11 at a position to be covered by the plunger during its movement towards the outlet, is a port 15 which communicates by way of passages within the housing, with a low pressure fuel inlet 16. The low pressure inlet also communicates with circumferential groove 17 formed in the periphery of the plunger and spaced from the end thereof presented to the outlet. The plunger is also provided with a further circumferential groove adjacent its other end and this groove is occupied by a fluid seal 18.

In operation when the plunger 13 is moved against the action of the spring 14, the port 15 is first covered and thereafter fuel is displaced from the bore through the outlet 12. When the plunger is allowed to return under the action of the spring 14, the port 15 is opened and a fresh charge of fuel is admitted to the bore. The groove 17 collects any fuel tending to leak along the working clearance defined between the plunger 13 and bore 11 during the time when the port 15 is covered and whilst fuel is being discharged to the engine.

Figure 3:
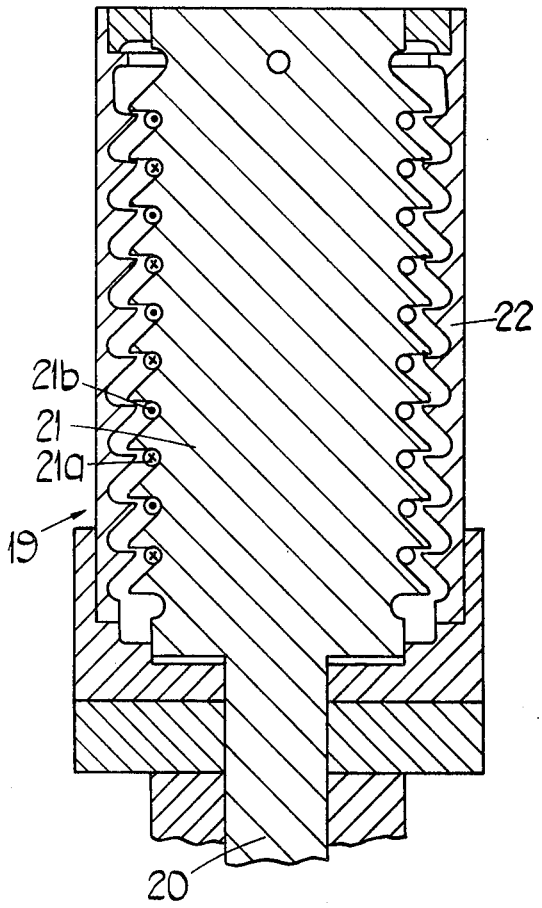
FIG. 3 is a sectional side elevation of one example of an electro-magnetic device forming part of the injector.

For actuating the plunger there is provided an electromagnetic device one example of which is seen in FIG. 3. The device includes an axially movable actuating pin 20 which can engage the plunger 13.

The device 19 includes an armature 21 which is connected to the actuating pin 20. Moreover, the device includes an annular stator member 22 which surrounds the armature 21 and formed in the presented surfaces of the armature and the member are in the particular example, intermeshing two start helical threads. One of the members in the example shown, the armature 21, is provided in the two thread grooves, with windings **21*a* 21*b* which can be supplied with electric current. The direction of current flow in the windings in the two thread grooves is in the opposite direction as seen by the dot and cross configuration, and the arrangement is such that when current is supplied to the windings the armature 21 will be moved downwardly as seen in FIG. 3** and similar movement will be imparted to the plunger.

The extent of movement of the armature 21 is very small but owing to the construction of the device the force developed is high and enables a considerable pressure of fuel to be developed. In addition, the armature and plunger 13 acquire before closure of the port 15, a considerable inertia which assists in the development of the required fuel pressure. The amount of fuel delivered by the injector is determined by the extent of travel of the armature 21 after the port 15 has been covered and this can be adjusted in any convenient manner for example the annular member 22 or the armature, may be relatively rotated to close or open the air gap existing between the thread profiles on the two parts. A return spring not shown is provided for the armature 21 and a stop to limit the return motion. It is not intended that the volume of fuel pumped should be adjustable during the operation of the associated engine.

In the example illustrated the armature 21 is provided with the windings. This does require the provision of flexible connectors to the windings. This difficulty may be overcome by providing the windings in the thread grooves in the annular member 22. Moreover, the armature 21 may be of hollow construction.

Figure 2:
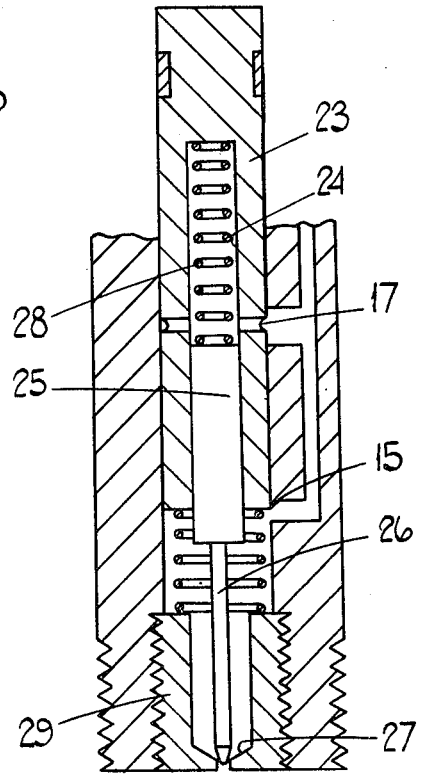
FIG. 2 shows a modified portion of the injector shown in FIG. 1.

In the example shown in FIG. 2, the plunger 23 is of modified construction as compared with the plunger 13. The plunger 23 is provided with a blind bore 24 extending from its end presented to the insert 29 defining the outlet. The bore 24 slidably mounts a cylindrical part 25 to which is attached an extension 26 shaped at its end to co-operate with a seating 27 defined about the outlet. The part 25 is loaded by means of a coiled compression spring 28 housed within blind end of the bore so that the extension is maintained in contact with the seating 27. The blind end of the bore communicates with the groove 17. The arrangement is such that when the port 15 is closed fuel pressure builds up in the bore as the plunger continues to move and this pressure acts on the part 25 to move same relative to the main portion of the plunger and against the action of the spring 28. When the plunger 23 ceases to move then the extension 26 moves into sealing engagement with the seat 27 to prevent further flow of fuel through the outlet and when the windings are de-energised the various parts return to their original positions with the extension 26 maintained in contact with the seating.

The injectors described since the amount of fuel delivered is not intended to be adjusted during operation of the associated engine may be used to supply fuel to a stratified charge engine. The supply of electric current to the windings is controlled by switch means operable in time relationship with the associated engine.

The injectors are of simple construction with few moving parts and particularly in the case of the example of FIG. 1 the insert 9 together with the valve controlled outlet can be easily renewed.

I claim:

1. A fuel pump injector for mounting on an internal combustion engine so as to deliver fuel to a combustion space of the engine, the injector comprising in combination a housing, a bore defined in the housing, a plunger slidable within the bore, an outlet at one end of the bore, a valve for controlling fuel flow through said outlet, a fuel supply port opening into the bore at a position so that it is covered by the plunger during movement thereof towards said one end of the bore and an electromagnetic device for urging the plunger towards said one end of the bore whereby when said port is covered fuel is discharged through said outlet, said injector including a return spring for said plunger, said outlet comprised of an insert which is retained in said bore at said one end thereof, said insert defining a valve seat, said valve cooperating with said seat, said valve comprising an extension which is mounted on a cylindrical port slidable within a bore formed in said plunger, said bore being a blind bore and housing a spring action to urge said extension into contact with said seat, wherein said blind bore communicates with a further port formed in the wall of the bore mounting the plunger, said port and further port communicating with a fuel supply passage in the housing.

2. An injector in accordance with claim 1 in which said electromagnetic device includes an armature and a winding which when energized effects movement of said plunger in a direction towards said one end of the bore, said device including resilient means which returns said armature when the winding is de-energized.

3. An injector as claimed in claim 2 in which the device also includes an annular stator member surrounding the armature, said stator member being secured to the housing, the stator member and armature each having on their presented faces two or a multiple of two start helical thread form, said winding comprising windings located in the grooves of the stator member or armature, the windings being connected so that the directions of current flow in adjacent grooves is in opposite directions.

4. An injector as claimed in claim 3 including a spring for returning the armature to a rest position when the winding is de-energised and a stop for determining the rest position.

5. An injector as claimed in claim 4 in which said return spring is interposed between the plunger and the insert.

6. An injector as claimed in claim 5 in which said plunger is provided with a circumferential groove intermediate its ends said groove communicating with a further port formed in the wall of the bore housing the plunger, said port and said further port communicating with a fuel inlet defined in the housing.

* * * * *